US007396245B2

(12) United States Patent
Huang et al.

(10) Patent No.: US 7,396,245 B2
(45) Date of Patent: Jul. 8, 2008

(54) MEMORY CARD CONNECTOR

(75) Inventors: Chung-hsin Huang, Tu-Cheng (TW); Mei-chuan Yang, Tu-Cheng (TW); Hsin-hui Chen, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/580,078

(22) Filed: Oct. 13, 2006

(65) Prior Publication Data

US 2008/0090437 A1 Apr. 17, 2008

(51) Int. Cl.
*H01R 24/00* (2006.01)

(52) U.S. Cl. ..... 439/188

(58) Field of Classification Search ..... 439/188, 439/489, 630

See application file for complete search history.

(56) References Cited

U.S. PATENT DOCUMENTS 6,045,049 A * 4/2000 Nishimura et al. ..... 235/486
6,380,474 B2 * 4/2002 Taruguchi et al. ..... 84/612
6,494,745 B1 * 12/2002 Schremmer ..... 439/630
6,619,991 B2 * 9/2003 Nishio et al. ..... 439/630
6,805,566 B2 * 10/2004 Chia-Chen ..... 439/188
6,875,057 B2 * 4/2005 Miyazawa et al. ..... 439/630
2004/0033722 A1 * 2/2004 Liu et al. ..... 439/630
2004/0219813 A1 * 11/2004 Chang ..... 439/188
2004/0259403 A1 * 12/2004 Chang ..... 439/188
2004/0259404 A1 * 12/2004 Chang ..... 439/188
2005/0009392 A1 * 1/2005 Chang ..... 439/188
2006/0089052 A1 * 4/2006 Lu et al. ..... 439/630
2006/0183378 A1 * 8/2006 Tanaka et al. ..... 439/630

* cited by examiner

*Primary Examiner*—Gary F. Paumen
(74) *Attorney, Agent, or Firm*—Rosenberg, Klein & Lee

(57) ABSTRACT

A memory connector includes an insulative housing, a plurality of terminals accommodated in the insulative housing, a cover engaged with the insulative housing and a switch mechanism secured in the insulative housing. The switch mechanism includes a first member and a second member. The first member keeps a proper distance to the second member. When a memory card is fully inserted into the memory card connector, the memory card passes over and pushes the first member to make electric connection to the second member. The connection between the first member and the second member generates a signal to judge whether the memory card is right inserted or not.

5 Claims, 6 Drawing Sheets

MEMORY CARD CONNECTOR

BACKGROUND OF THE INVENTION

1. Field of the Invention

The present invention relates to an electric connector, and more particularly, to a memory card connector.

2. The Related Art

Memory cards are known in the art and contain intelligence in the form of a memory circuit or other electronic program. Usually, a card reader reads the information or memory stored on the card. Such cards are used in many applications in today's electronic society, including video cameras, digital still cameras, smartphones, PDA's, music players, ATMs, cable television decoders, toys, games, PC adapters, multimedia cards and other electronic applications. Typically, a memory card includes a contact or a terminal array for connection through a card connector to a card reader system and then to an external equipment. The connector readily accommodates insertion and removal of the card to provide quick access to the information and program on the card. The card connector includes terminals for yieldingly engaging the contact array of the memory card.

The memory card may be inserted into the card connector of an electronic device insufficiently and fails to make electric connection therebetween, but the user turns on the electronic device as usual; as a result, the electronic device fails to start-up. Hence an improved card connector which is able to judge whether the memory card is right inserted or not is desired to overcome the above-mentioned shortcoming.

SUMMARY OF THE INVENTION

Accordingly, the object of the present invention is to provide a memory card connector to overcome the shortage mentioned-above.

The memory connector provided includes an insulative housing, a plurality of terminals accommodated in the insulative housing, a cover engaged with the insulative housing, and a switch mechanism secured in the insulative housing. The switch mechanism includes a first member and a second member. The first member further includes a first retained portion, a clasping portion extending from the retained portion for firmly securing the first member in the insulative housing and making electric connection to a printed circuit board, a spring arm extending from the retained portion and further forming a contact portion at its free end. The second member includes a second retained portion, a soldering end and a second contact portion connected to the retained portion.

The first member keeps a proper distance to the second member, when a memory card is fully inserted into the memory card connector, the memory card passes over and pushes the first contact portion to make electric connection with the second contact portion. The connection between the first contact portion and second contact portion generates a signal to judge weather the memory card is fully inserted or not. Therefore, the user can start the electronic device only in condition of the memory card is fully inserted into the memory card connector.

These and other features, objects and advantages of the present invention will be more fully apparent from the following detailed description set forth below when taken in conjunction with the accompanying drawings.

DETAILED DESCRIPTION OF THE PREFERRED EMBODIMENT

Figure 1:
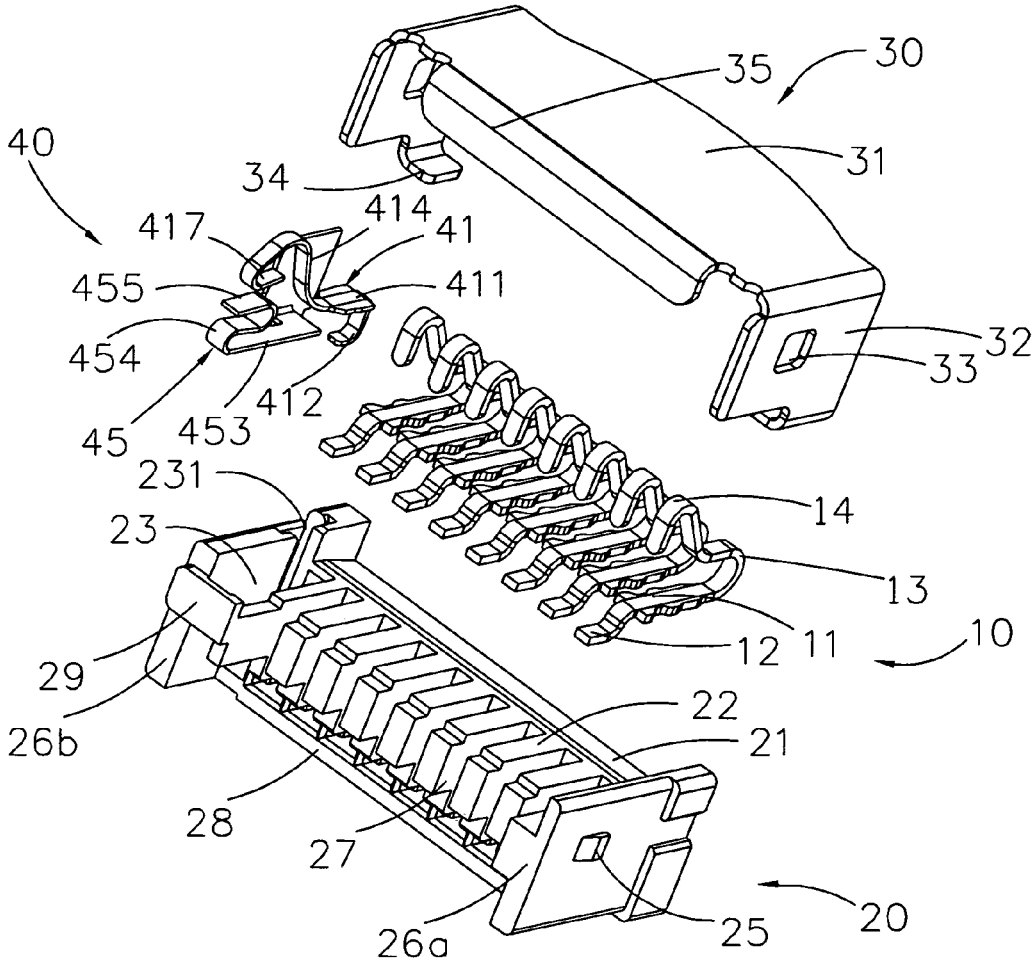
FIG. 1 is an exploded view of a memory card connector according to the present invention.

With reference to FIG. 1, a memory card connector according to the present invention is illustrated which includes an insulative housing 20, a cover 30 engaged with the insulative housing 20, a plurality of terminals 10 and a switch mechanism 40 accommodated in the insulative housing 20.

Figure 2:
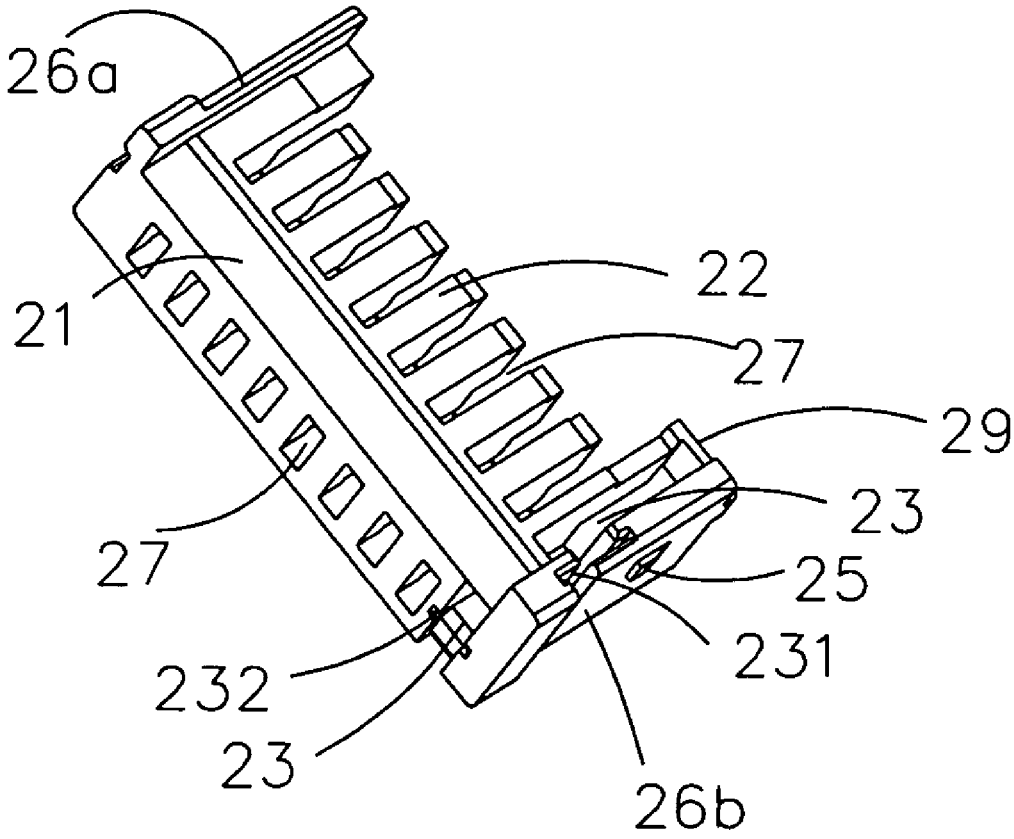
FIG. 2 is a perspective view of an insulative housing of the memory card connector.

Please refer to FIG. 1 and FIG. 2; the insulative housing 20 further includes a base portion 22, a rear wall 21 formed on the rear end of the base portion 22, an upright first sidewall 26*a* and an upright second sidewall 26*b* formed on both sides of the base portion 22, and a bottom wall 28 positioned in the bottom of the base portion 22. A plurality of parallel terminal passages 27 defined in the base portion 22 penetrates the rear wall 21 and open upwards for accommodating corresponding terminal 10 therein. A switch groove 23 for accommodating the switch mechanism 40 is defined between the second sidewall 26*b* and the base portion 22. Part of the switch groove 23 penetrates the rear wall 21 with positioning troughs 232 defined in both sides. A fixing slot 231 is formed in the second sidewall 26*b* upright, further more, the slot 231 opened to the switch groove 23 in the front end and to outside in the rear end. A stopper 29 makes connection between the second sidewall 26*b* and the base portion 22 in the front opposite to the rear wall. Moreover, each sidewall 22*a*, 22*b* has a bulge 25 formed on its outside.

Figure 3:
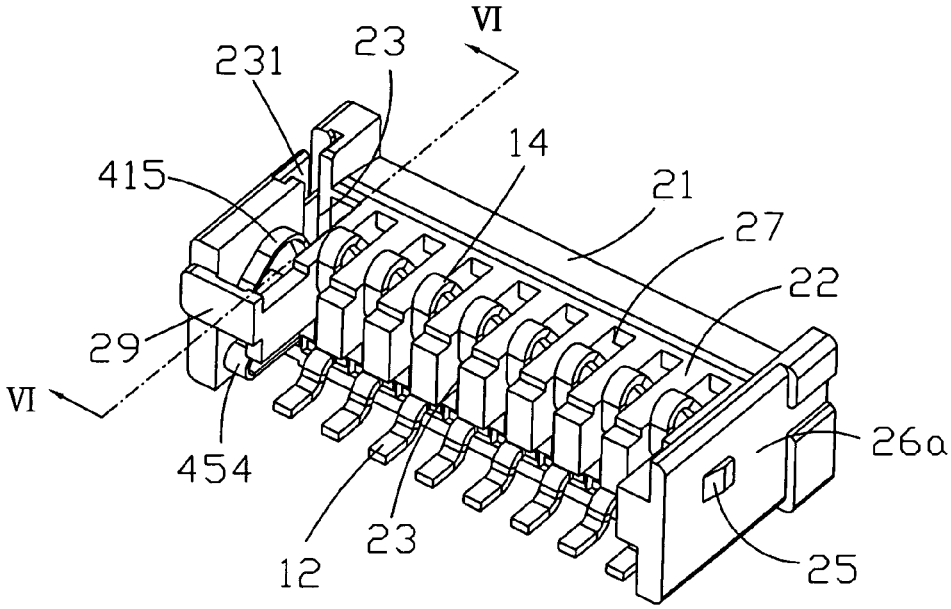
FIG. 3 is an assembled perspective view of the memory card connector with a cover removed, looking from the front.
Figure 4:
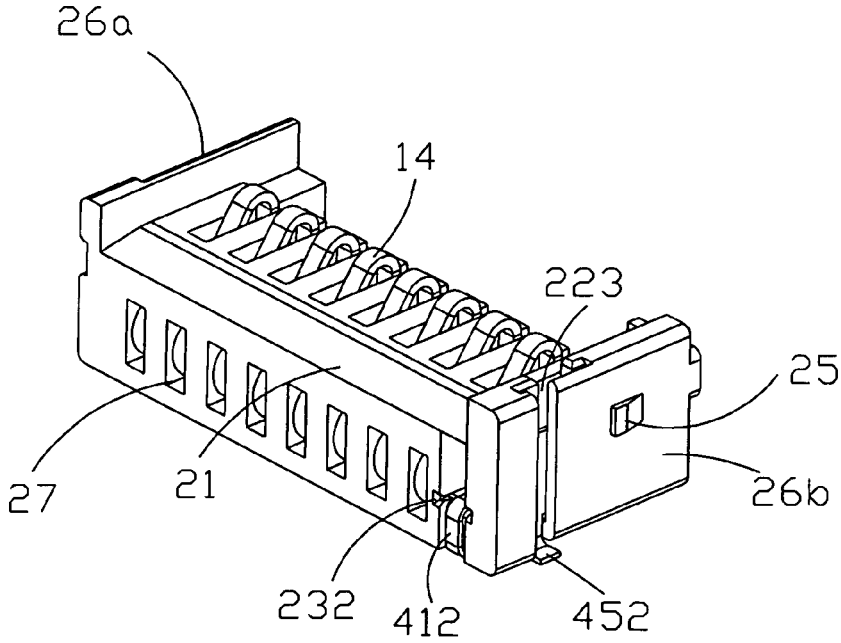
FIG. 4 is an assembled perspective view of the memory card connector of FIG. 3, looking from the back.
Figure 5:
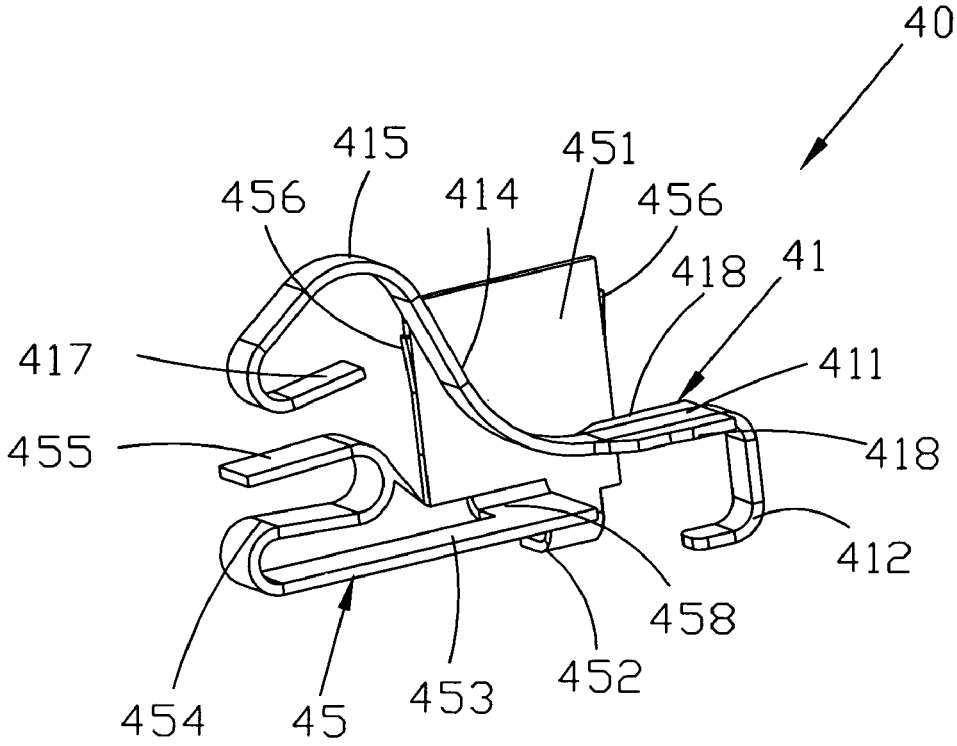
FIG. 5 is a perspective view of a switch mechanism of the memory card connector.
Figure 6:
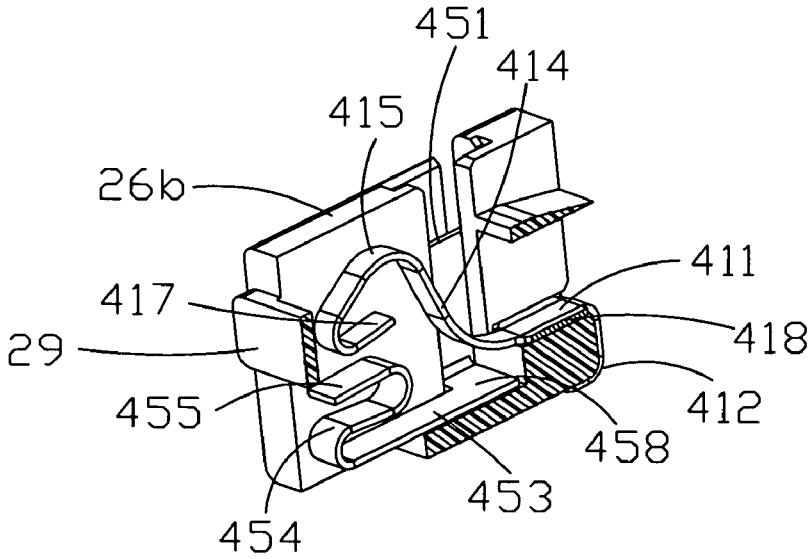
FIG. 6 is a cross-section view of the memory card connector along line VI-VI of FIG. 3.

Please refer to FIG. 1 and FIG. 3; each terminal 10 of the terminal array accommodated in respective terminal passage 27 includes a secured portion 11 for securing the terminal 10 in corresponding passage 27, a soldering tail 12 extending from the secured portion 12 and exploded outside of the insulative housing 20 for solder connection to a printed circuit board (not shown), a spring portion 13 extending from another end of the secured portion 11, and a peak portion 14 further extending from the spring portion 13 for making electric communication to a memory card.

Now refer to FIG. 1, FIG. 4, FIG. 5 and FIG. 6; the switch mechanism 40 which installed in the switch groove 23 includes a first member 41 and a second member 45. Further more, the first member 41 has a first retained portion 411 with wings 418 defined in both sides. The first retained portion 411 rides on the bottom wall 28 of the insulative housing 20, meanwhile, the wings 418 are positioned into the positioning troughs 232. The first retained portion 411 further protrudes downwards and forms a clasping portion 412 thereof. The clasping portion 412 clasps the bottom wall 28 to firmly secure the first member 41 of the switch mechanism 40 in the insulative housing 20 and makes electric connection to a printed circuit board (not shown). A first spring arm 414 stretches upwards and forwards and further forms a vault 415 thereon. The distal of the vault 415 further extends at an angle back and forms a first contact portion 417. The second member 45 which positioned under the first member 41 in the switch groove 23 of the insulative housing 20 includes a second retained portion 453, a second spring arm 454 extending back, a second contact portion 455 further folded back for making connection to the first contact portion 417. The second contact portion 455 is right under the first contact portion 417 and keeps a proper distance to the first contact portion 417. A bridge 458 extends perpendicularly from another end of the second retained portion 453 and further defines a fixing plate 451 thereof. The bridge 458 goes from the switch groove 23 to the fixing slot 23. Further more, the fixing plate 451 positioned in the fixing slot 231 defines barbs 456 on both sides for firmly securing the fixing plate 451 in the fixing slot 231. A soldering end 452 extends outside the insulative housing 20 from the fixing plate 451 for solder connection to the printed circuit board and implementing electric connection therebetween. Alternatively, the switch mechanism 40 can be installed in the first sidewall 26*a* of the insulative housing 20 as well.

Figure 7:
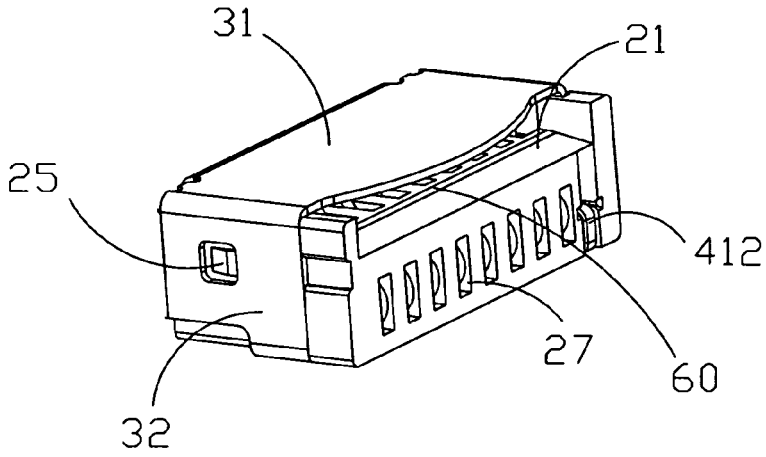
FIG. 7 is an assembly perspective view of the memory card connector.

Further refer to the FIG. 1 and FIG. 7, the cover 30 includes a base plane 31, a front edge board 35 extending downwards from the front of the base plane 31, a pair of lateral wall 32 extending downwards from the lateral side of the base plane 31. Further more, the lateral wall 32 defines a hole 33 to receive the bulge 25 therein and a hook 34 protrudes inwards from the free end of the lateral wall 32. The hook 34 clasps the bottom wall 28 to secure the cover 30 with the insulative housing 20.

Now refer to FIG. 7; a card receiving port 60 is formed between the base plane 31 of the cover 30 and the base portion 22 of the insulative housing 20. The peak portions 14 of the terminals 10 are exploded in the card receiving port 60 in order to make electric connection to a memory card.

Figure 8:
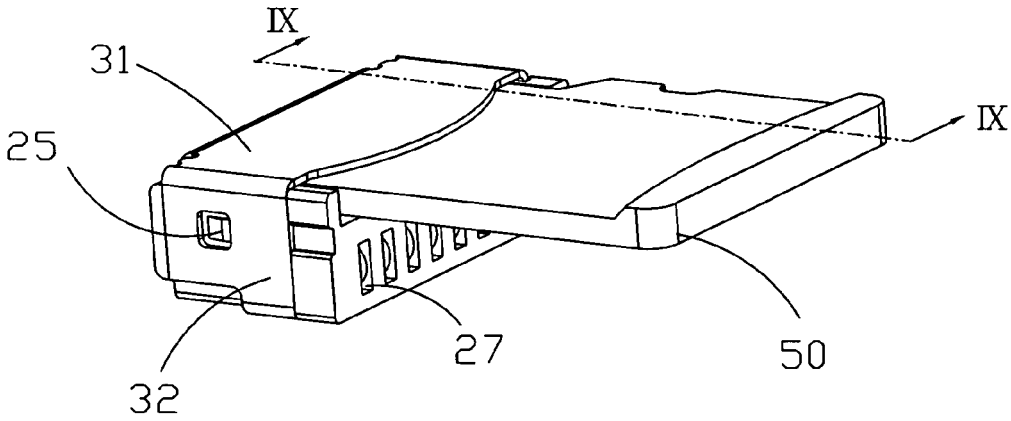
FIG. 8 is an assembled perspective view of the memory card connector with a memory card inserted therein.
Figure 9:
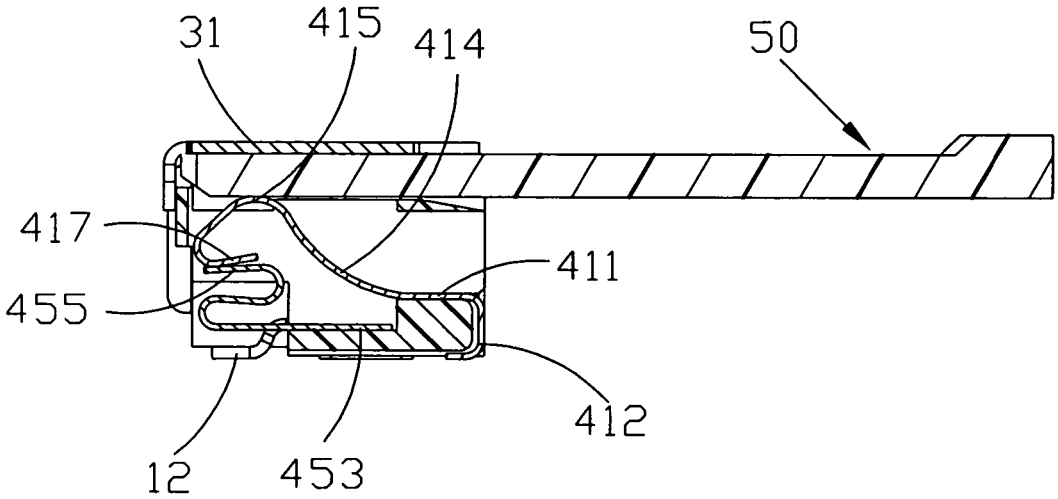
FIG. 9 is a cross-section view of the memory card connector with a memory card inserted therein of FIG. 8 along line IX-IX.

Further refer to FIG. 8 and FIG. 9; when a memory card 50 is fully pushed into the card receiving port 60, the memory card 50 passes over the vault 415 of the first member 41 and pushes the first contact portion 417 down. Finally, the memory card 50 is stopped by the front edge board 35. Meanwhile, the pushed-down first contact portion 417 reaches the second contact portion 455 and makes electric connection therebetween. In another hand, when the memory card 50 is pulled out the card receiving port 60, the memory card firstly slides off the switch mechanism 40 and the first contact portion 417 of the first member 41 bounds back keeping a certain distance to the second contact portion 455 again.

The connection between the first contact portion 417 and second contact portion 455 generates a signal to judge whether the memory card 50 is fully inserted or not. Therefore, the user starts the electronic device only in condition of the memory card 50 is fully inserted into the memory card connector.

Although a preferred embodiment of the present invention has been described in detail hereinabove, it should be clearly understood that many variations and/or modifications of the basic inventive concepts herein taught which may appear to those skilled in the present art will fall within the spirit and scope of the present invention, as defined in the appended claims.

What is claimed is:

1. A memory card connector comprising:

an insulative housing having a plurality of passages;

a plurality of terminals accommodated in said passages;

a cover engaged with said insulative housing, said cover including a front edge board to stop a fully inserted memory card from moving forwardly; and a switch mechanism, secured in said insulative housing having a first member and a second member, said first member further having a first retained portion, a clasping portion extending from said retained portion for firmly securing said first member in said insulative housing and making electric connection to a printed circuit board, a first spring arm extending from said first retained portion and further forming a first contact portion at its free end, said second member comprising a second retained portion, a soldering end and a second contact portion connected to said second retained portion, wherein initially said first member keeps a distance from said second member, when a memory card is fully inserted into said memory card connector, said memory card passes over and pushes said first contact portion to make electric connection to said second contact portion.

2. The memory card connector as claimed in claim 1, wherein said second member comprises a fixing plate secured in said insulative housing.

3. The memory card connector as claimed in claim 2, wherein said fixing plate defines barbs on both sides for firmly securing said fixing plate in said insulative housing.

4. The memory card connector as claimed in claim 1, wherein the soldering end of said second member makes electric connection between said second member and a printed circuit board.

5. The memory card connector as claimed in claim 1, wherein said first retained portion of first member defines wings on both sides thereof.

* * * * *